US007490828B2

(12) United States Patent
Machida et al.

(10) Patent No.: US 7,490,828 B2
(45) Date of Patent: Feb. 17, 2009

(54) IMAGE-BASED EDGE DETECTION OF STACKED SHEET MEDIA

(75) Inventors: Akihiro Machida, Sunnyvale, CA (US); Masatoshi Yamai, Tokyo (JP)

(73) Assignee: Avago Technologies ECBU IP (Singapore) Pte. Ltd., Singapore (SG)

( * ) Notice: Subject to any disclaimer, the term of this patent is extended or adjusted under 35 U.S.C. 154(b) by 449 days.

(21) Appl. No.: 11/252,085

(22) Filed: Oct. 17, 2005

(65) Prior Publication Data

US 2007/0085263 A1 Apr. 19, 2007

(51) Int. Cl.
*B65H 1/00* (2006.01)

(52) U.S. Cl. ..... 271/145

(58) Field of Classification Search ..... 271/171, 271/145, 162; 399/13, 16, 23, 24, 43, 45, 399/389, 393

See application file for complete search history.

(56) References Cited

U.S. PATENT DOCUMENTS 5,053,814 A * 10/1991 Takano et al. ..... 399/23
5,096,180 A 3/1992 Nagaoka et al.
5,629,672 A * 5/1997 Brown et al. ..... 340/540
5,812,280 A * 9/1998 Kwan-Bo ..... 358/406
5,839,015 A 11/1998 Faguy et al.
6,100,993 A 8/2000 Eom
6,366,744 B1 * 4/2002 Phillips et al. ..... 399/24
6,583,891 B2 6/2003 Joyce
6,585,344 B2 7/2003 Kolodziej
6,636,704 B2 * 10/2003 Weaver et al. ..... 399/23
6,823,148 B2 * 11/2004 Weaver et al. ..... 399/23
6,929,417 B2 8/2005 Boudreau

* cited by examiner

*Primary Examiner*—Patrick H Mackey
*Assistant Examiner*—Thomas A Morrison

(57) ABSTRACT

In one aspect, an apparatus includes a receptacle for holding a stack of sheet media, an image sensor, and a sheet media edge detector. The image sensor generates image data in response to light received from a view encompassing edges of ones of the sheet media held in the receptacle. The sheet media edge detector detects edges of individual ones of the sheet media in the image data generated by the image sensor. In another aspect, a stack of sheet media is held. Image data is generated in response to light received from a view encompassing edges of ones of the sheet media in the stack. Edges of individual ones of the sheet media are detected in the image data.

19 Claims, 10 Drawing Sheets

IMAGE-BASED EDGE DETECTION OF STACKED SHEET MEDIA

BACKGROUND

Many rendering systems, such as printers, copying machines, and fax machines, are designed to apply markings on sheet media, such as paper. The sheet media typically are held in a supply bin or a removable paper tray or cassette. Sheet media must be loaded into the supply bin or paper tray of a rendering system when the supply of sheet media has run out.

Currently available rendering systems typically include sensors that trigger a notification signal when the supply bin or paper tray is empty. Many of these types of systems, however, are incapable of determining the number of sheets remaining in the supply bin or paper tray. As a result, users of these systems are unable to determine whether there is a sufficient amount of sheet media in the rendering system to complete a rendering job.

Several potential solutions that attempt to address this problem have been proposed. These solutions typically involve measuring the height of the stack of sheet media in the supply bin or paper tray and inferring the number of sheets remaining from the measured stack height. In particular, the number of sheets remaining is estimated by dividing the measured stack height by an estimate of the thickness of the individual sheets. The sheet thickness may be a predetermined value or it may be inferred from the reduction in the measured stack height after each sheet is fed into the rendering system.

The accuracy of such inferential sheet counting methods, however, may be quite low, especially when the supply bin or paper tray may have been loaded inadvertently with sheets having different thicknesses. In addition, such methods cannot detect the presence of different types of sheets having different thickness before the sheets have been fed into the rendering system. As a result, these methods cannot warn users when different types of sheets are about to be used for a rendering job.

What are needed are improved systems and methods of detecting and monitoring sheet media in rendering systems that are capable of accurately counting the number of sheets and determining when sheets of different thickness are about to be used for a rendering job.

SUMMARY

In one aspect, the invention features an apparatus that includes a receptacle for holding a stack of sheet media, an image sensor, and a sheet media edge detector. The image sensor generates image data in response to light received from a view encompassing edges of ones of the sheet media held in the receptacle. The sheet media edge detector detects edges of individual ones of the sheet media in the image data generated by the image sensor.

In one aspect, the invention features a method in accordance with which a stack of sheet media is held. Image data is generated in response to light received from a view encompassing edges of ones of the sheet media in the stack. Edges of individual ones of the sheet media are detected in the image data.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

I. Overview

The embodiments that are described in detail below provide improved systems and methods of detecting and monitoring sheet media in rendering systems. Some of these embodiments are capable of accurately counting at least a minimum number of sheets remaining in a sheet media receptacle. Some of these embodiments are capable of determining when sheets of different thickness are about to be used for a rendering job. In these ways, the embodiments that are described herein enable users to use rendering systems with greater efficiency and to avoid wasting sheet media consumables.

Figure 1:
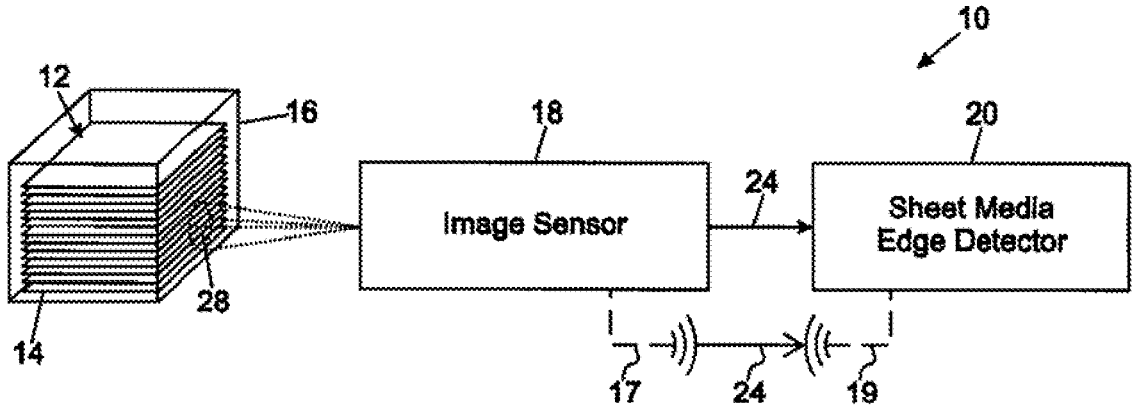
FIG. 1 is a diagrammatic view of an embodiment of a system for detecting edges of individual sheets of stacked sheet media.

FIG. 1 shows an embodiment of a system 10 for detecting edges of individual sheets in a stack 12 of sheet media 14, which are held in a receptacle 16. In general, the sheet media 14 may be formed of any type of medium that may be marked by a rendering system, including paper (e.g., precut paper sheets, envelopes, and labels) and plastic (e.g., transparencies). The edge detection system 10 includes an image sensor 18 and a sheet media edge detector 20.

Figure 2:
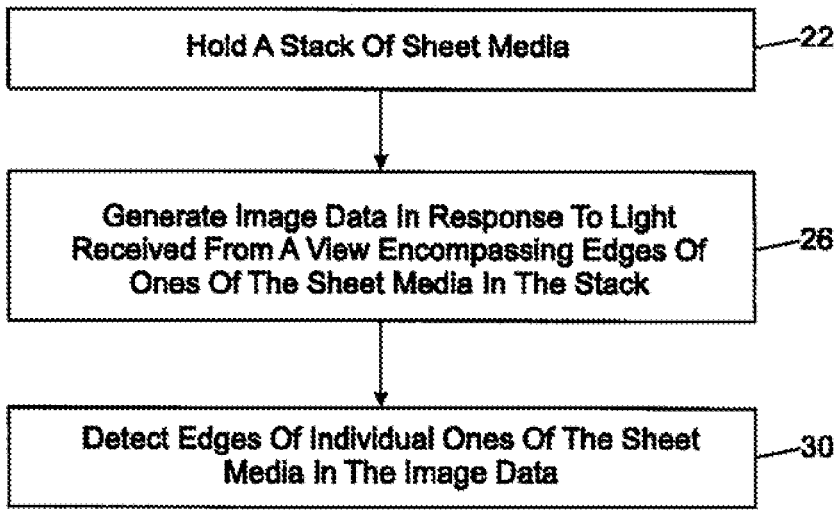
FIG. 2 is a flow diagram of an embodiment of a method of detecting edges of individual sheets of stacked sheet media.

FIG. 2 shows an embodiment of a method by which the edge detection system 10 detects edges of individual sheets in the stack 12 of sheet media 14.

The receptacle 16 holds the stack 12 of sheet media 14 (FIG. 2, block 22). The receptacle 16 may be implemented by any type of holder or container that is capable of holding the sheet media stack 12. Exemplary embodiments of the receptacle 16 include a supply bin, a removable paper tray, and a removable cassette. In general, the receptacle 16 allows the image sensor 18 to have an unobstructed view of the edges of at least some of the sheet media 14 in the stack 12. In some implementations, the receptacle 16 includes a window through which the image sensor 18 can view the edges of the sheet media 14 in the stack 12. In other implementations, at least a portion of the receptacle 16 is transparent to light within a specified wavelength range (e.g., the visible wavelength range or the infrared wavelength range) that the image sensor 18 is capable of detecting.

The image sensor 18 generates image data 24 in response to light received from a view 28 that encompasses the edges of ones of the sheet media 14 in the stack 12 (FIG. 2, block 26). The image sensor 18 may be any type of image sensor, including a charge-coupled device (CCD) image sensor or a complementary metal-oxide-semiconductor (CMOS) image sensor. The image sensor 18 may include one or more lenses that focus light that is reflected form the edges of the sheet media 14 onto the active area of the image sensor 18. The edges of the sheet media may be illuminated by ambient light or by a light source (e.g., a light emitting diode or a laser diode). According to one embodiment, and as illustrated in FIG. 1, wireless transmitter 17 is provided, and is operable to wirelessly transmit image data 24 from image sensor 18 to receiver 19 located on sheet media edge detector 20.

The view 28 of the image sensor 18 typically encompasses the bottom ones of the sheets 14 in the stack 12. In some implementations, the view 28 extends vertically from the bottom sheet level up to a view level that is at least as high as the specified maximum sheet media capacity level of the receptacle 16. In other implementations, the view 28 extends vertically from the bottom sheet level only up to a view level that is lower than the specified maximum sheet media capacity level of the receptacle. In embodiments in which the view does not encompass the maximum sheet media capacity level of the receptacle 16, the view level typically is selected to be large enough for the image sensor 18 to view the edges of at least a minimum number of sheets. In some implementations, the minimum number of sheets is set to a level that covers typical rendering jobs, a number which typically is application dependent. For example, for typical home user applications the minimum number of sheets may be 10-25 sheets, whereas for typical business applications the minimum number of sheets may be 25-50 sheets or higher.

The sheet media edge detector 20 detects edges of individual ones of the sheet media 14 in the image data 24 that is generated by the image sensor 18 (FIG. 2, block 30). The sheet media edge detector 20 may be implemented by one or more discrete modules that are not limited to any particular hardware or software configuration and may be implemented in any computing or processing environment, including in digital electronic circuitry (e.g., application-specific integrated circuits) or in computer hardware, firmware, device driver, or software.

The sheet media edge detector 20 may detect the edges of the sheet media 14 in the image data 24 in any of a wide variety of different ways. In some embodiments, the sheet media edge detector 20 averages the image data 24 corresponding to pixels of the image sensor 18 that are parallel to the edges of the sheet media 14 (i.e., orthogonal to the sheet stacking direction). The sheet media edge detector 20 filters the averaged image data through a low-pass filter to reduce noise. The sheet media edge detector 20 then applies a threshold to the filtered image data to detect peaks in the filtered image data.

Figure 3:
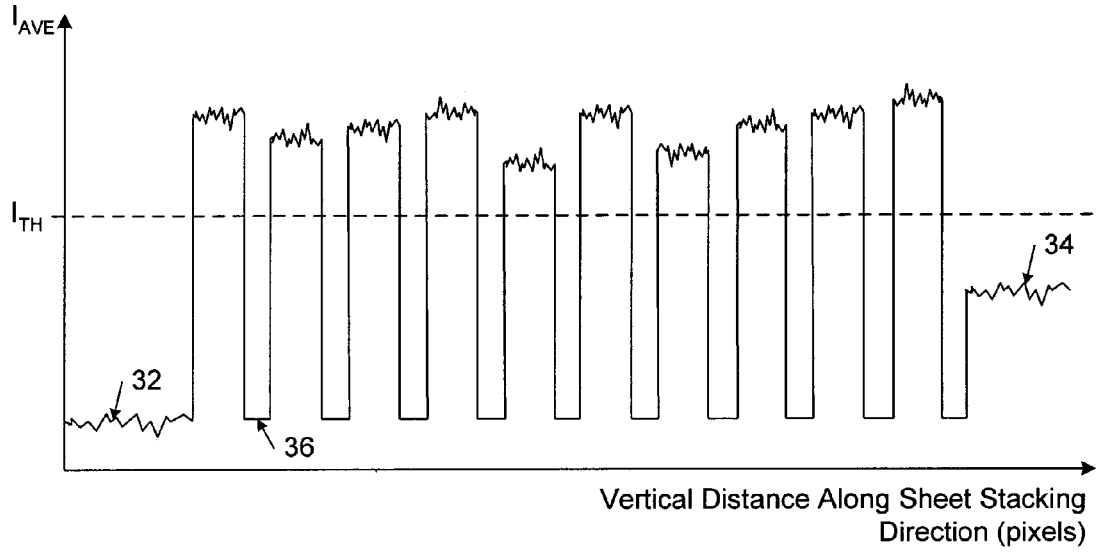
FIG. 3 is a graph of average pixel intensity plotted as a function of vertical distance along the sheet stacking direction.

FIG. 3 shows an exemplary graph of pixel intensity values ($I_{AVE}$) in the image date 24 that have been low-pass-filtered and averaged in the direction orthogonal to the sheet stacking direction. The filtered and averaged pixel values are plotted as a function of vertical distance along the sheet stacking direction from the bottom of the view 28, which typically corresponds to the support surface at the bottom of the receptacle 16. The exemplary threshold $I_{TH}$ is selected to distinguish the pixel values corresponding to the edges of the sheet media 14 from the pixel values 32 generated from light received from below the stack (e.g., from reflections from the receptacle 16), pixel values 34 generated from light received from above the stack 12, and pixel values 36 generated from light received from between the sheets.

In general, the sheet media edge detector 20 may perform a wide variety of status monitoring functions based on the detected edges of the sheet media 14 in the image data 24.

For example, in some embodiments, the sheet media edge detector 20 counts the number of peaks in the graph shown in FIG. 3 to determine the number of sheet media 14 within the view 28. The determined number of sheets may be used, for example, to warn a user before or during the execution of a rendering job that the number of sheets in the receptacle 16 is insufficient to complete the rendering job.

In some implementations, the sheet media edge detector 20 measures the thicknesses of the peaks to determine the thicknesses of the sheet media 14 within the view 28. In some of these implementations, the relative sheet media thicknesses are measured in pixel distances. In other implementations, the sheet media thicknesses are determined by using the peak thicknesses measured in pixels as an index into a predetermined lookup table that maps pixel distances to sheet media thicknesses. The measured thicknesses may be compared to each to determine whether sheets having different thicknesses are loaded in the receptacle. This information may be used, for example, to warn a user that different types of sheet media are about to be used to render a rendering job.

II. Exemplary Embodiments of the Edge Detection System

Figure 4:
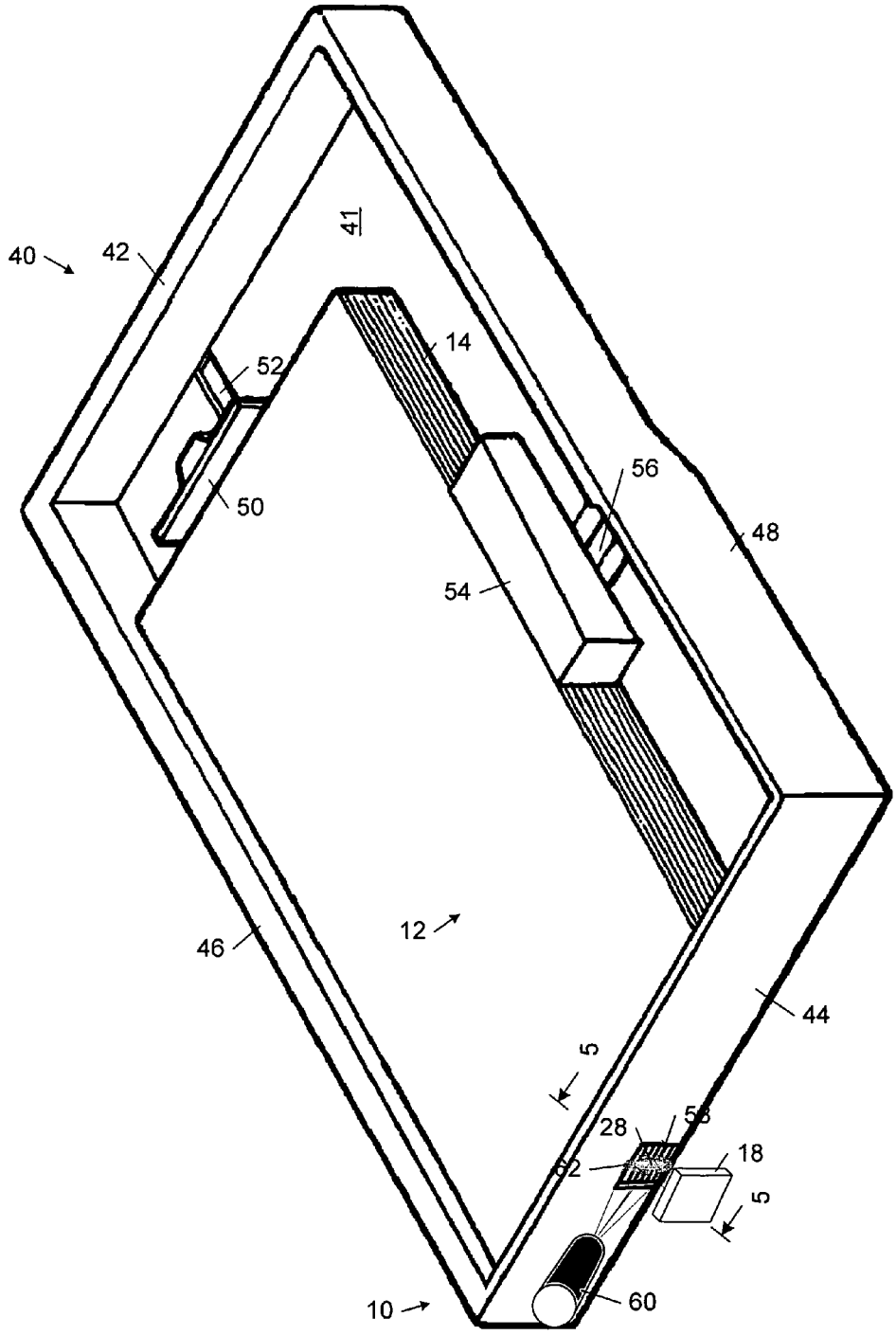
FIG. 4 is a diagrammatic perspective view of an embodiment of a sheet media receptacle and components of an implementation of the sheet media edge detection system shown in FIG. 1.

FIG. 4 shows an implementation 40 of the receptacle 16 that is shaped in the form of a tray or cassette that is selectively movable into and out of a bay of a rendering system. The receptacle 40 has a bottom support 41 for supporting the sheet media stack 12, a front wall 42, a back wall 44, and two side walls 46, 48. The back wall 44 and the side wall 46 serve as edge stops against which respective edges of the sheet media 14 in the stack 12 abut when they are stacked in the receptacle 40. The receptacle 40 includes a front sheet media guide 50 that is slidable in a slot 52 toward and away from the back edge stop 44 to accommodate different lengths of sheet media 14. The receptacle also includes a side media guide 54 that is slidable in a slot 56 toward and away from the side edge stop 46 to accommodate different widths of sheet media 14. In operation, the front and side media guides 50, 54 are positioned to accommodate the length and width of the sheet media 14 and the sheet media 14 are loaded into the space within the receptacle defined by the media guides 50, 54 and the edge stops 44, 46.

The back wall 44 of the receptacle 40 includes a window 58 through which the image sensor 18 views the edges of the sheet media 14 stacked in the receptacle 40. In the embodiment shown in FIG. 4, the window 58 provides a view of the edges of the sheet media 14 that are stacked in the receptacle 40 up to a sheet media stack level that is lower than the maximum sheet capacity level of the receptacle 40. In other embodiments, the window 58 provides a view of the edges of all of the sheet media 14 up to the maximum sheet capacity level of the receptacle. 40. In the illustrated embodiment, the window consists of a rectangular opening in the back wall 44 of the receptacle 40. In general, the window may have any shape, including polygonal, elliptical, and circular. In some embodiments, the window 58 includes a material (e.g., glass or plastic) that is transparent to light within a specified wavelength range (e.g., the visible wavelength range or the infrared wavelength range) that the image sensor 18 is capable of detecting.

The implementation 40 of the sheet media edge detection system 10 shown in FIG. 4 includes a light source 60 that illuminates the edges of the sheet media 14 within the view 28 of the image sensor 18. The light source 60 may be implemented by any type of light source (e.g., a light emitting diode or a laser diode) that is capable of illuminating the edges of the sheet media 14 that are exposed through the window 58. In some embodiments, the area 62 of the sheet media edges that is illuminated by the light source 60 encompasses the view 28 of the image sensor 18. In the illustrated embodiment, the sheet media 14 are stacked parallel to a common stacking plane at least near the edges viewed by the image sensor. The light source 60 illuminates the edges of the sheet media within the view 18 along an optical axis that intersects the stacking plane. This feature of the light source 60 increases the contrast of the edges of the sheet media in the image data 24 that is generated by the image sensor 18.

Figure 5:
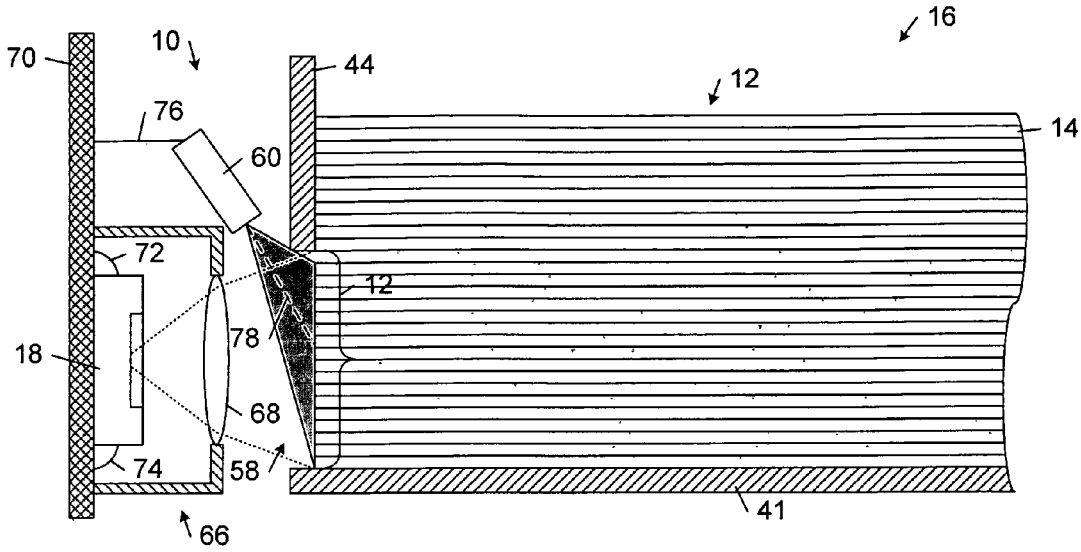
FIG. 5 is a diagrammatic sectional view of an implementation of the sheet media edge detection system and a portion of the sheet media stack held in the receptacle shown in FIG. 4 taken along the line 5-5.

FIG. 5 shows a sectional view of an embodiment of the sheet media edge detection system 10 and a portion of the sheet media stack held in the receptacle 40 shown in FIG. 4 taken along the line 5-5. In this embodiment, the image sensor 18 is incorporated in a housing 64 of an image sensor module 66. The housing 64 supports a lens 68, which directs light reflected from the view 28 to the active area of the image sensor 18. The image sensor module 66 and the light source 60 are mounted on a substrate 70. In the illustrated embodiment, the substrate 70 is an interconnection substrate, such as a printed circuit board. The image sensor 18 is electrically connected to the substrate 70 by bond wires 72, 74 and the light source is electrically connected to the substrate 70 by an electrical conductor 76. The light source 60 illuminates the edges of the sheet media 14 that are exposed through the window 58 along an optical axis 78 that intersects a sheet media stacking plane that is defined by the surface of the support wall 41 supporting the stack 12 of sheet media 14 near the window 58.

Figure 6A:
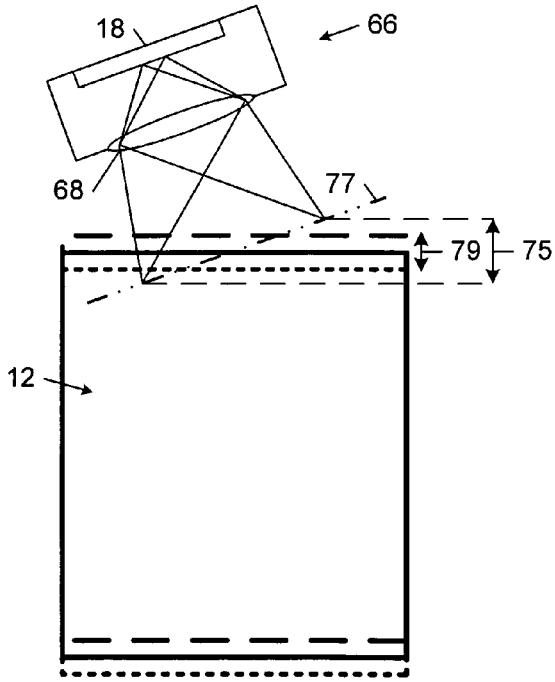
FIG. 6A is a diagrammatic top view of an embodiment of an image sensor that is arranged to have a large depth of focus with respect to edges of sheets in a sheet media stack.

FIG. 6A shows a diagrammatic top view of an embodiment of the image sensor module 66 that is arranged to have a large depth of focus 75 with respect to edges of sheets in the sheet media stack 12. In this embodiment, the image sensor module 66 is tilted in relation to the sheet media edges about the sheet stacking direction normal to the plane of FIG. 6A so that the focal plane 77 intersects the edges of the sheet media 14 that are exposed through the window 58. The region of focus typically is selected to accommodate the tolerance variations 79 between the image sensor module 66 and the sheet media stack 12 (e.g., the variations of the sheets within the receptacle 16 and the variations of the receptacle within the bay of the rendering system). In this way, at least some portion of the view 28 of the sheet media edges will be in focus so that the sheet media edge detector 20 can discriminate the individual sheets from one another in the image data 24 despite variations in the position of the sheet stack 12 in relation to the image sensor module 66.

Figure 6B:
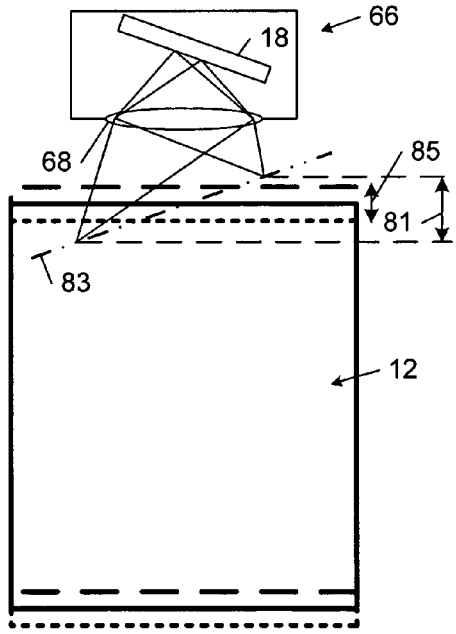
FIG. 6B is a diagrammatic top view of an embodiment of an image sensor that is arranged to have a large depth of focus with respect to edges of sheets in a sheet media stack.

FIG. 6B is a diagrammatic top view of another embodiment of the image sensor module 66 that is arranged to have a large depth of focus 81 with respect to edges of sheets in the sheet media stack 12. In this embodiment, the image sensor 18 is tilted with respect to the lens 68 about the sheet stacking direction normal to the plane of FIG. 6B so that the focal plane 83 intersects the edges of the sheet media 14 that are exposed through the window 58. The region of focus typically is selected to accommodate the tolerance variations 85 between the image sensor module 66 and the sheet media stack 12 (e.g., the variations of the sheets within the receptacle 16 and the variations of the receptacle within the bay of the rendering system). In this way, at least some portion of the view 28 of the sheet media edges will be in focus so that the sheet media edge detector 20 can discriminate the individual sheets from one another in the image data 24 despite variations in the position of the sheet stack 12 in relation to the image sensor module 66.

Figure 7A:
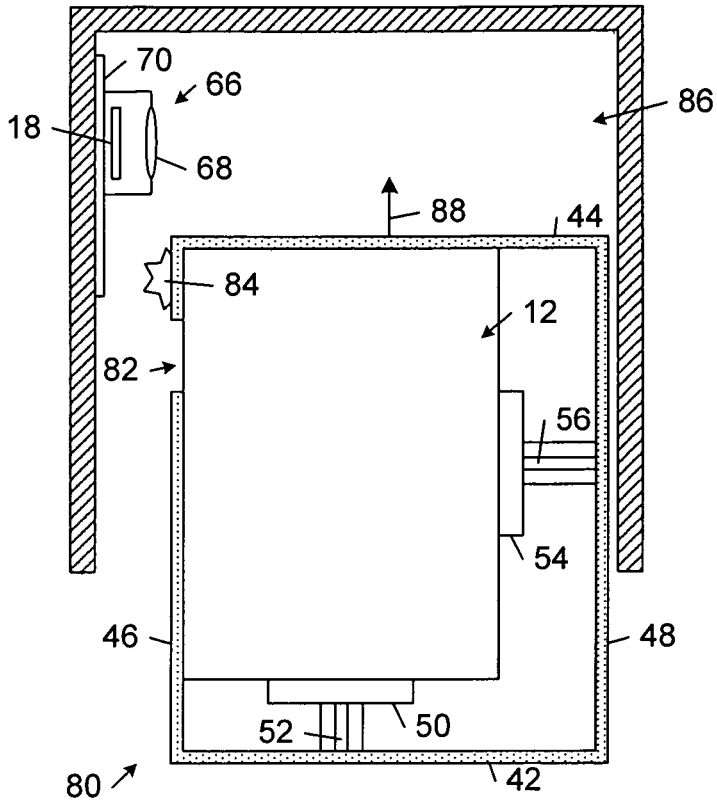
FIG. 7A is a diagrammatic top view of an embodiment of a receptacle that includes a lens cleaner and is being loaded into an embodiment of a rendering system that includes an embodiment of the image sensor shown in FIG. 1.

FIG. 7A shows an implementation 80 of the receptacle 16 that includes a window 82 in the side wall 46 instead of in the back wall 44. A lens cleaner 84 is mounted to the side wall 46 at a location adjacent to the window 82. The lens cleaner 84 may be formed of any material that is capable of wiping contaminants (e.g., paper dust and ink or toner particles) off the surface of the lens 68 of the image sensor module 66. In some embodiments, the lens cleaner 84 is formed of a conformable material, such as a fabric, an elastomer, and a sponge.

Figure 7B:
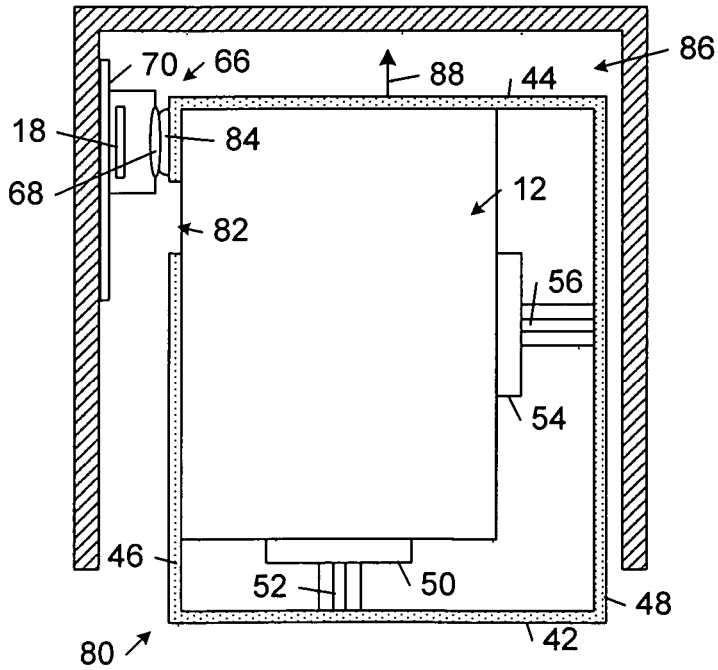
FIG. 7B is a diagrammatic top view of the receptacle shown in FIG. 7A with the lens cleaner wiping the surface of the lens of the image sensor as the receptacle is being loaded into the rendering system.
Figure 7C:
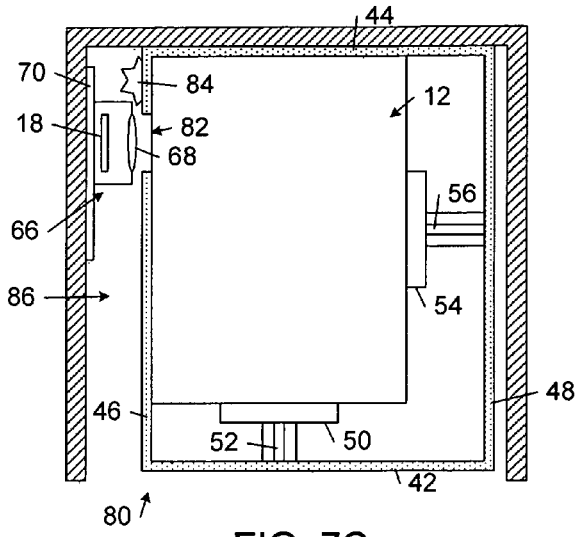
FIG. 7C is a diagrammatic top view of the receptacle shown in FIG. 7A completely loaded into the rendering system.

Referring to FIG. 7B, as the receptacle 80 is loaded into a bay 86 of a rendering system in the direction of arrow 88, the lens cleaner 84 conforms to the surface of the lens 68 and mechanically wipes contaminants, debris, and residue off the surface of the lens 68. As shown in FIG. 7C, when the receptacle 80 is loaded completely within the bay 86, the lens cleaner 84 does not obstruct the image sensor's view 28 of the edges of the sheet media 14 through the window 82.

Figure 8A:
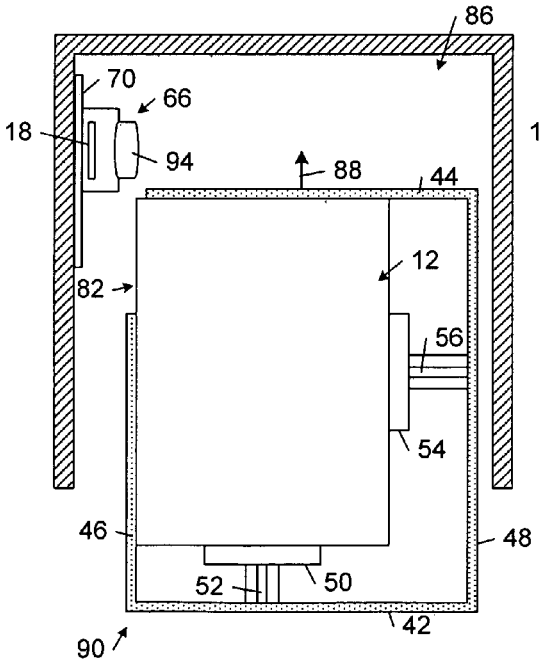
FIG. 8A is a diagrammatic top view of an embodiment of a receptacle that is holding a stack of sheet media and is being loaded into an embodiment of a rendering system that includes an embodiment of the image sensor shown in FIG. 1.
Figure 8B:
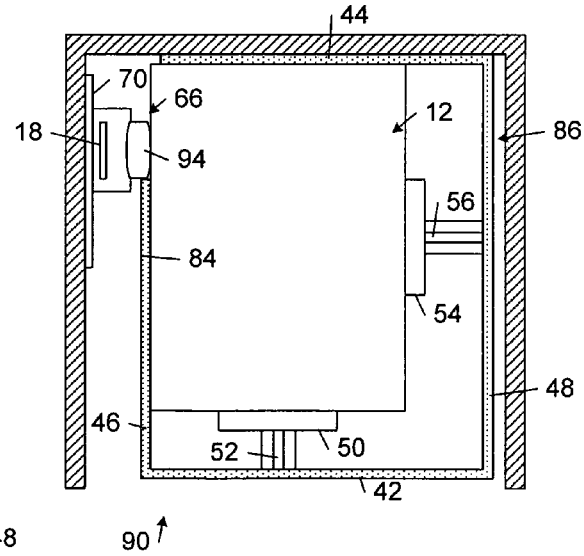
FIG. 8B is a diagrammatic top view of the receptacle shown in FIG. 8A with the sheet media wiping the surface of the lens of the image sensor as the receptacle is being loaded into the rendering system.

FIGS. 8A and 8B show another implementation 90 of the receptacle 16 that includes a window 92 in the side wall 46 that extends to the back wall 44. The window 92 exposes a portion of the edges of the sheet media 14 that abut the side wall 46 as well as a portion of the edges of the sheet media 14 that abut the back wall 44. With respect to this implementation of the receptacle 16, the image sensor module 66 includes an elongated rod lens 94 that extends a sufficient distance into the bay 86 so that the end of the rod lens 94 contacts the edges of the sheet media exposed by the window 92 when the receptacle 90 is loaded into the bay 86 of the rendering system. In this way, the edges of the sheet media 14 operate to mechanically wipe contaminants, debris, and residue off the surface of the lens 94. Referring to FIG. 8B, when the receptacle 90 is loaded completely within the bay 86, the rod lens 94 extends through the window 92 and abuts the edges of the sheet media 14.

Figure 9A:
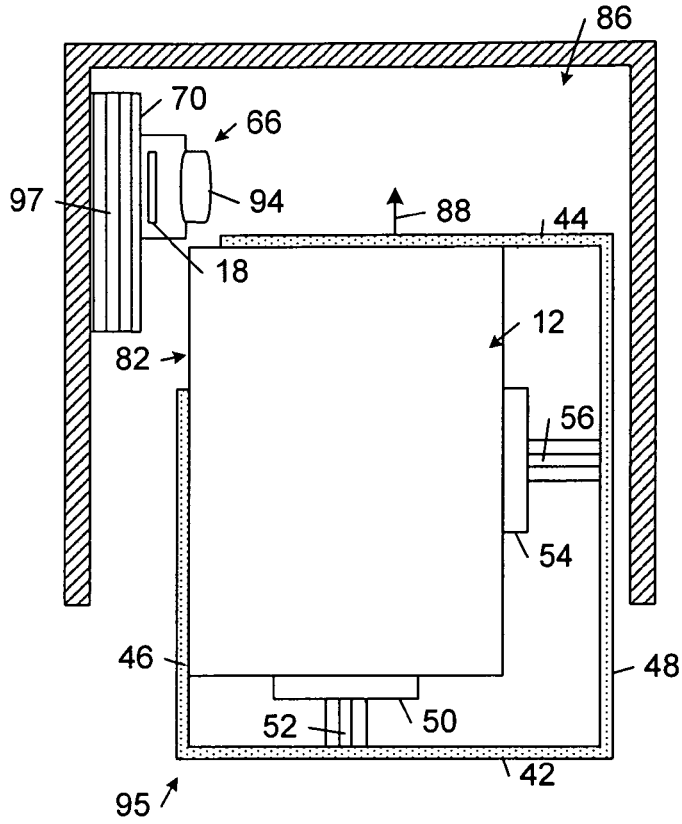
FIG. 9A is a diagrammatic top view of an embodiment of a receptacle that is holding a stack of sheet media and is being loaded into an embodiment of a rendering system that includes an embodiment of the image sensor shown in FIG. 1.
Figure 9B:
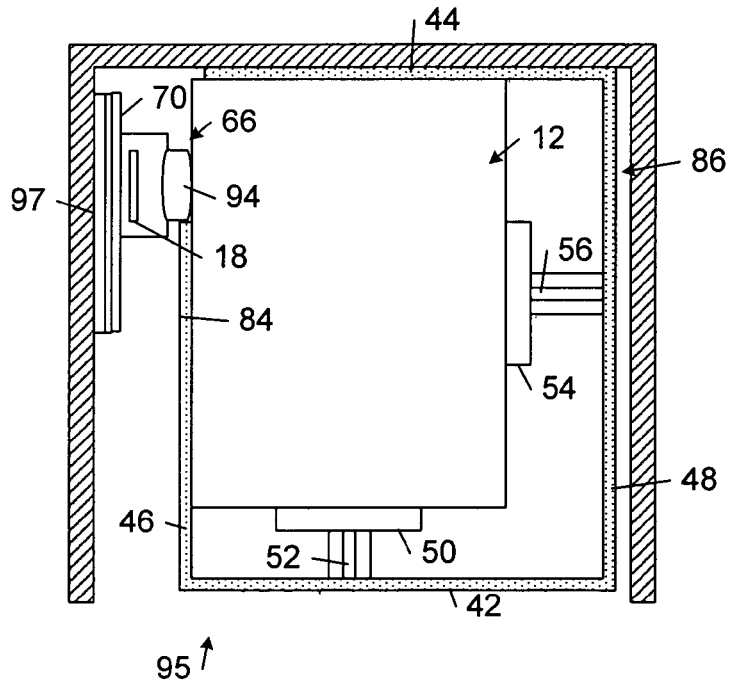
FIG. 9B is a diagrammatic top view of the receptacle shown in FIG. 9A with the sheet media wiping the surface of the lens of the image sensor as the receptacle is being loaded into the rendering system.

FIG. 9A and 9B show another implementation 95 of the receptacle 16 that corresponds to the receptacle implementation 90, except that the receptacle implementation 95 additionally includes a compliant member 97. The compliant member 97 may be implemented by any type of compliant material or structure that is capable of exerting a restoring force that resists compression of the compliant member. As shown in FIG. 9B, when the receptacle 95 is loaded within the bay 86, the compliant member 97 is compressed by the force that is applied by the edges of the sheet media 14 to the exposed surface of the rod lens 94. In response, the compliant member 97 exerts a restoring force that urges the rod lens 94 against the edges of the sheet media 14. In this way, the edges of the sheet media 14 operate to mechanically wipe contaminants, debris, and residue off the surface of the lens 94.

III. Eexmplary Systems Incorporating the Edge Detection System

Figure 10:
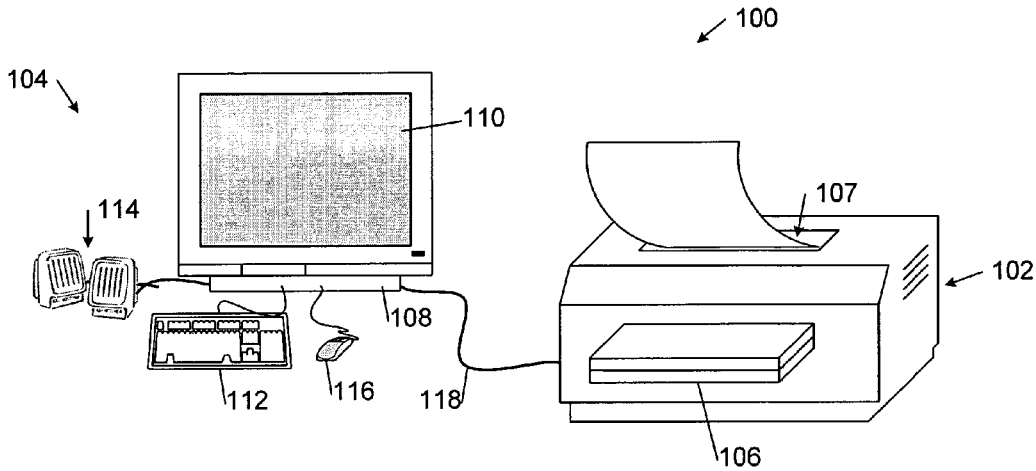
FIG. 10 is a diagrammatic view of an embodiment of a rendering system connected to an embodiment of a computer system.

FIG. 10 shows an exemplary apparatus 100 that incorporates the edge detection system 10. The apparatus 100 includes a rendering system 102 and a computer system 104. The rendering system 102 may be any type of system that is capable of marking the sheets in the sheet media stack 12, including a laser printer, an inkjet printer, a fax machine, a multifunction printing device, and a special-purpose printing device. The rendering system 102 includes a removable receptacle 106 for holding a stack of sheet media and an output 107 for dispensing marked sheets of the sheet media. The computer system 104 may be any type of general-purpose or special-purpose computing or processing system, including a personal computer and a workstation computer. The computer system 104 includes a housing 108 that contains processing and memory components of the computer system 104, a display 110, a keyboard 112, speakers 114, and an input device 116. In the illustrated embodiment, the computer system 104 is coupled to the rendering system 102 by a communication cable 118 (e.g., a printer cable, a USB cable, or an Ethernet cable).

Figure 11:
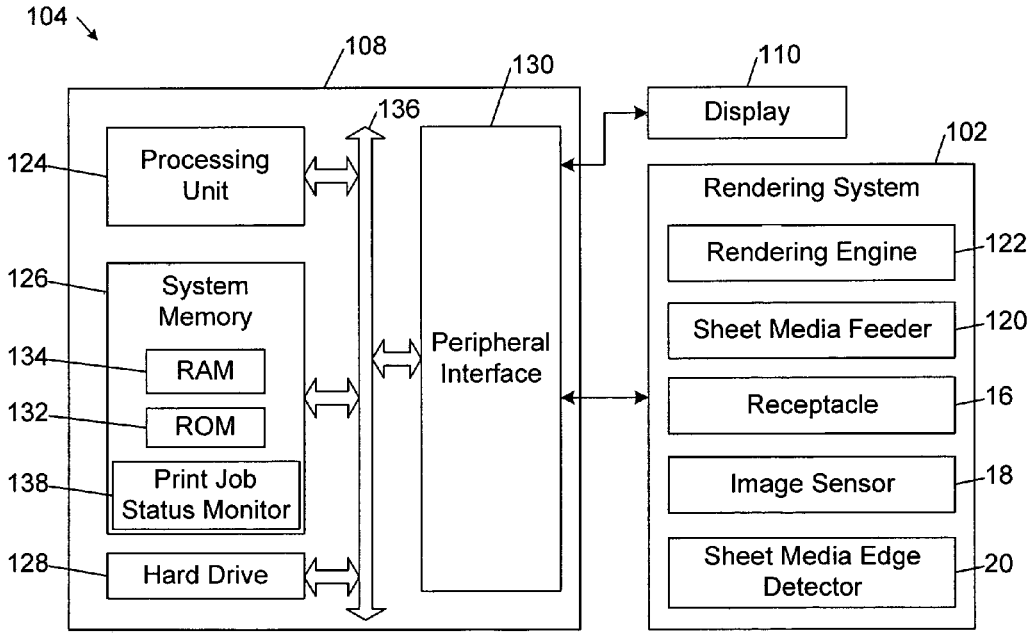
FIG. 11 is a block diagram showing components of implementations of the rendering system and the computer system shown in FIG. 10.

FIG. 11 shows a block diagram of components of an embodiment of the apparatus 100.

The rendering system 102 includes the image sensor 18, the sheet media edge detector 20, the sheet media receptacle 16, a sheet media feeder 120, and a rendering engine 122. The sheet media feeder 120 may be any type of sheet feed mechanism that is capable of extracting seriatim individual sheet media from the receptacle 16 and feeding the extracted sheets to the rendering engine 122. The rendering engine 122 may be any type of print engine that is capable of marking the sheets fed by the sheet media feeder 120.

The computer system 104 includes a processing unit 124, a system memory 126, a hard drive 128, and a peripheral interface 130. The processing unit 124 may include one or more processors, each of which may be in the form of any one of various commercially available processors. Generally, each processor receives instructions and data from a read-only memory and/or a random access memory. The system memory 126 includes a read only memory (ROM) 132 that stores a basic input/output system (BIOS) that contains start-up routines for the computer, and a random access memory (RAM) 134. A system bus 136 couples the processing unit 124 to the various components in the housing 108. The system bus 136 may be a memory bus, a peripheral bus or a local bus, and may be compatible with any of a variety of bus protocols, including PCI, VESA, Microchannel, ISA, and EISA. The hard drive 128 is connected to the system bus 136 by an interface. The hard drive 128 contains one or more computer-readable media disks that provide non-volatile or persistent storage for data, data structures and computer-executable instructions. Other computer-readable storage devices (e.g., floppy drives, CD ROM drives, magnetic tape drives, flash memory devices, and digital video disks) also may be incorporated in the housing 108. The peripheral interface 130 includes one or more cards that provide sockets and other hardware and firmware support for interconnections between the components of the housing 103 and the display 110 and the rendering system 102.

The system memory 126 also includes print job status monitor 138 that resides in the system memory 126 of the computer system 104. The print job status monitor 138 monitors the status of various aspects of the rendering system and generates reports or warnings based on the monitored statuses. The print job status monitor 138 communicates with the sheet media edge detector 20 over the communication cable 118. The print job status monitor 138 may be implemented by one or more discrete modules that are not limited to any particular hardware or software configuration and may be implemented in any computing or processing environment, including in digital electronic circuitry (e.g., application-specific integrated circuits) or in computer hardware, firmware, device driver, or software.

Figure 12:
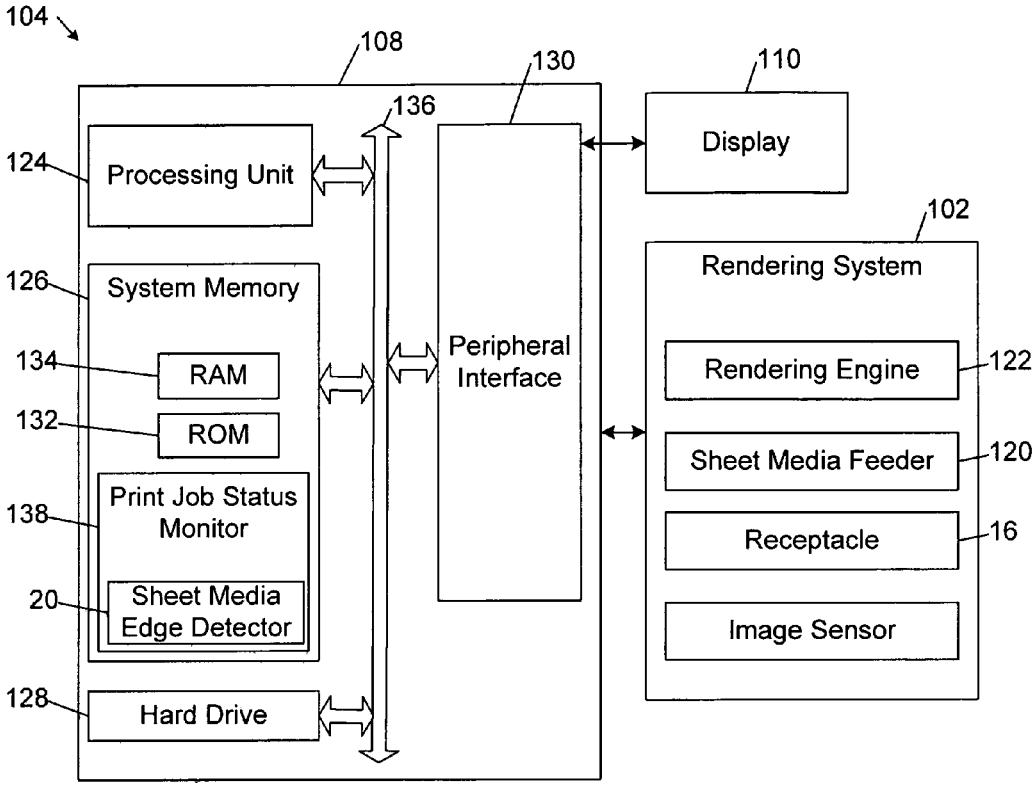
FIG. 12 is a block diagram showing components of implementations of the rendering system and the computer system shown in FIG. 10.

FIG. 12 shows a block diagram of components of another embodiment of the apparatus 100 that corresponds to the embodiment shown in FIG. 11 except that the sheet media edge detector 20 is incorporated within the print job status monitor 138 that resides in the system memory 126 of the computer system 104. The sheet media edge detector 20 receives the image data 24 that is generated by the image sensor 18 over the communication cable 118. The print job status monitor 138 generates reports or warnings based on the information generated by the sheet media edge detector 20 from the detected edges of the sheet media 14 in the image data 24.

In addition to common print job status monitor functions (e.g., reporting that the printer is ready, busy, offline, disconnected, or out of paper), the print job status monitor 138 in each of the embodiments shown in FIGS. 11 and 12 generates reports or warnings based on the information generated by the sheet media edge detector 20 from the detected edges of the sheet media 14 in the image data 24. Exemplary warnings that may be generated by the print job status monitor 138 are described below in connection with FIGS. 13, 14, and 15.

Figure 13:
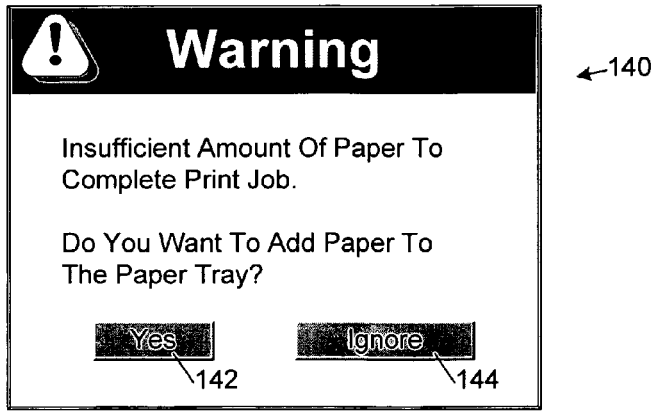
FIG. 13 shows an embodiment of a graphical user interface warning.

FIG. 13 shows an embodiment in which the print job status monitor 138 generates a warning 140 before the execution of a rendering job based on the number of sheets that are determined dynamically by the sheet media edge detector 20. In particular, the warning 140 is presented on the display 110 to warn a user that the number of sheets in the receptacle 16 is insufficient to complete a rendering job in the print queue. The warning 140 prompts the user to select a Yes button 142 if the user would like to add paper to the receptacle 16 before the rendering system 102 begins the print job or an Ignore button 144 if the user would like the rendering system 102 to begin the print job without adding additional paper to the receptacle 16.

Figure 14:
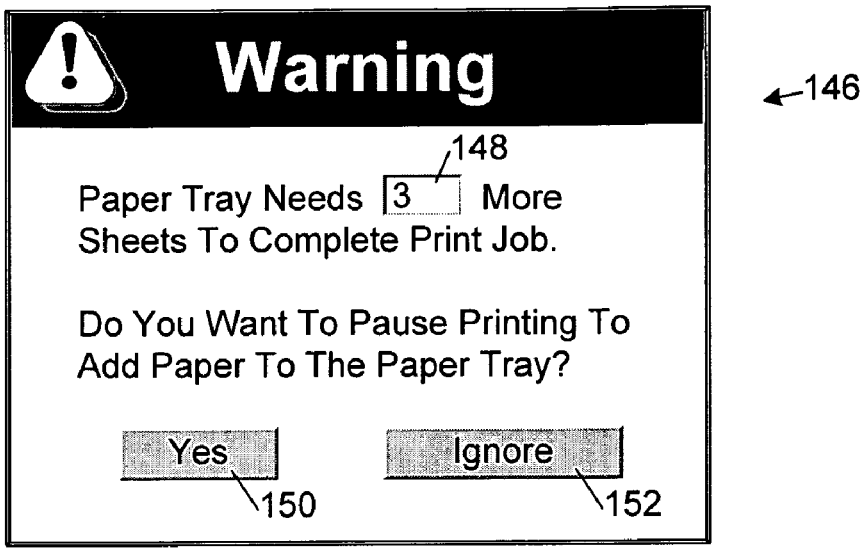
FIG. 14 shows an embodiment of a graphical user interface warning.

FIG. 14 shows an embodiment in which the print job status monitor 138 generates a warning 146 during the execution of a rendering job based on the number of sheets that are determined dynamically by the sheet media edge detector 20. In particular, the warning 146 is presented on the display 110 to warn a user that the number of sheets in the receptacle 16 is insufficient to complete the current rendering job. The warning 146 specifies the number of sheets remaining the receptacle in a text box 148. The warning 146 also prompts the user to select a Yes button 150 if the user would like to pause the print job so that the user can add paper to the receptacle 16 or an Ignore button 152 if the user would like the rendering system 102 to continue printing without adding additional paper to the receptacle 16.

Figure 15:
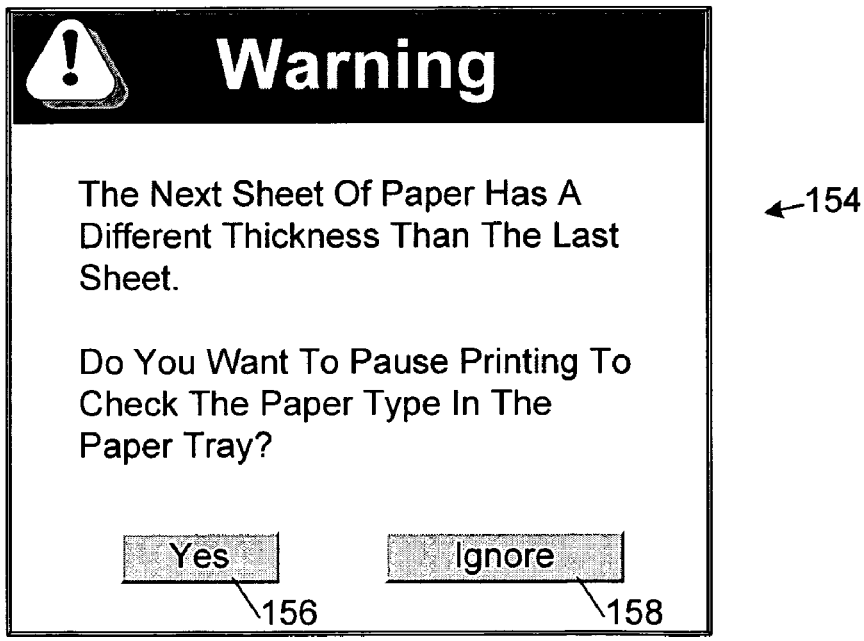
FIG. 15 shows an embodiment of a graphical user interface warning.

FIG. 15 shows an embodiment in which the print job status monitor 138 generates a warning 154 during the execution of a rendering job based on the sheet thicknesses that are measured dynamically by the sheet media edge detector 20. With respect to this embodiment, either the sheet media edge detector 20 or the print job status monitor 138 compares the sheet thicknesses determined for each successive sheet to each to determine whether sheets having different thicknesses are loaded in the receptacle. The print job status monitor 138 uses this information to warn a user that different types of sheet media are about to be used to render a rendering job. In particular, the warning 154 indicates that the next sheet of paper has a different thickness than the last sheet. The warning 154 prompts the user to select a Yes button 156 if the user would like to pause the print job so that the user can check the type of paper in the receptacle 16 or an Ignore button 152 if the user would like the rendering system 102 to continue printing without checking the type of paper in the receptacle 16.

IV. Conclusion

The embodiments that are described in detail above provide improved systems and methods of detecting and monitoring sheet media in rendering systems. Some of these embodiments are capable of accurately counting at least a minimum number of sheets remaining in a sheet media receptacle. Some of these embodiment are capable of determining when sheets of different thickness are about to be used for a rendering job. In these ways, the embodiments that are described herein enable users to use rendering systems with greater efficiency and to avoid wasting sheet media consumables.

Other embodiments are within the scope of the claims.

What is claimed is:

1. An apparatus, comprising:

a receptacle for holding a stack of sheet media;

an image sensor operable to generate image data in response to light received from a view encompassing edges of ones of the sheet media held in the receptacle;

a sheet media edge detector operable to detect edges of individual ones of the sheet media in the image data generated by the image sensor;

a housing, comprising:

a rendering engine operable to mark the sheet media;

the image sensor;

the receptacle; and a sheet media feeder operable to extract seriatim individual sheet media from the receptacle; and an optical element operable to direct light from the view to the image sensor;

wherein the receptacle is movable within the housing, and further comprising a cleaner attached to the receptacle operable to wipe a surface of the optical element in response to movement of the receptacle within the housing.

2. The apparatus of claim 1, wherein the receptacle comprises a bottom support for supporting the stack of sheet media and an edge stop against which edges of the sheet media abut when stacked in the receptacle, the edge stop comprising a window through which the image sensor views the edges of sheet media stacked in the receptacle.

3. The apparatus of claim 2, wherein the window provides a view of the edges of sheet media stacked in the receptacle up to a sheet media stack level lower than a specified maximum sheet media capacity level of the receptacle.

4. The apparatus of claim 2, wherein the receptacle comprises at least one sheet media guide that is adjustable in relation to the edge stop to accommodate different sheet media sizes.

5. The apparatus of claim 1, further comprising a light source operable to illuminate edges of ones of the sheet media within the view.

6. The apparatus of claim 5, wherein sheet media are stackable parallel to a stacking plane near the edges of ones of the sheet media viewed by the image sensor, and the light source is operable to illuminate the edges of ones of the sheet media within the view along an optical axis that intersects the stacking plane.

7. The apparatus of claim 1, wherein the sheet media edge detector is operable to generate at least one condition signal indicative of a condition of the sheet media in the receptacle based on the detected edges.

8. The apparatus of claim 1, wherein the sheet media edge detector is operable to determine a count of individual ones of the sheet media in the image data.

9. The apparatus of claim 8, wherein the sheet media edge detector is operable to generate a condition signal indicative of the determined count.

10. The apparatus of claim 8, wherein the sheet media edge detector is operable to compare the count with a specified number of sheet media need to complete a rendering job and to trigger an alert in response to a determination that the count is less than the specified number of sheet media.

11. The apparatus of claim 1, wherein the sheet media edge detector is operable to measure thicknesses of individual ones of the sheet media in the image data.

12. The apparatus of claim 11, wherein the sheet media edge detector is operable to detect a sheet medium having a different thickness than other sheet media stacked in the receptacle based on the measured thicknesses.

13. The apparatus of claim 12, wherein the sheet media edge detector is operable to generate a condition signal indicative of the detection of a different sheet type in response to the detection of the sheet medium having the different thickness.

14. The apparatus of claim 12, wherein the sheet media edge detector is operable to trigger an alert in response to the detection of the sheet media having the different thickness.

15. The apparatus of claim 1, wherein the receptacle is movable within the housing and is constructed and arranged so that edges of sheet media in the receptacle contact an exposed surface of the optical element when the receptacle is loaded within the housing.

16. The apparatus of claim 15, further comprising a compliant member configured to urge the exposed surface of the optical element against edges of the sheet media in the receptacle when the receptacle is loaded within the housing.

17. The apparatus of claim 1, wherein the sheet media edge detector is attached to the housing.

18. The apparatus of claim 1, further comprising a wireless transmitter operable to wirelessly transmit the image data to the sheet media edge detector.

19. The apparatus of claim 1, wherein the sheet media edge detector resides on a computer attached to the apparatus.

* * * * *